US008029378B1

(12) United States Patent
Adams

(10) Patent No.: US 8,029,378 B1
(45) Date of Patent: Oct. 4, 2011

(54) APPARATUS AND METHODS FOR TRAINING A GOLF STROKE

(76) Inventor: Cleveophis Adams, Encinitas, CA (US)

( * ) Notice: Subject to any disclaimer, the term of this patent is extended or adjusted under 35 U.S.C. 154(b) by 0 days.

(21) Appl. No.: 12/763,958

(22) Filed: Apr. 20, 2010

(51) Int. Cl.
*A63B 69/36* (2006.01)

(52) U.S. Cl. ..... 473/203; 473/201; 473/219

(58) Field of Classification Search ..... 473/201, 473/203, 204, 206, 219, 226, 227, 231, 266, 473/276
See application file for complete search history.

(56) References Cited

U.S. PATENT DOCUMENTS 4,511,147 A * 4/1985 Olsen ..... 473/203
5,904,624 A * 5/1999 Martinez ..... 473/212
6,004,221 A * 12/1999 Thornhill ..... 473/227
6,805,640 B2 * 10/2004 Kim et al. ..... 473/226
2007/0149301 A1 * 6/2007 Cox ..... 473/207

OTHER PUBLICATIONS

Medicus Golf, Medicus Dual Hinge Driver, URL: http://www.medicus.com, Accessed on Apr. 20, 2010.

* cited by examiner

*Primary Examiner* — Nini Legesse
(74) *Attorney, Agent, or Firm* — Mandour & Associates, APC

(57) ABSTRACT

An apparatus for training a golf stroke comprising: a grip for orienting the user's hands; a restraining bar for orienting the user's arms mechanically coupled to one end of the grip; a shaft mechanically coupled to the end of the grip opposite the restraining bar; and an indicator for the user to determine the orientation of the apparatus mechanically coupled to the end of the shaft opposite the grip. Such apparatus and related methods facilitate training a golfer to swing a golf club by executing a stroke with a proper grip, posture, alignment, balance, and movement during setup, backswing, downswing, and follow-through.

18 Claims, 5 Drawing Sheets

APPARATUS AND METHODS FOR TRAINING A GOLF STROKE

BACKGROUND OF THE INVENTION

The present invention pertains to an apparatus and method for training a golf stroke or swing.

A properly executed conventional club stroke in the sport of golf propels a golf ball with the speed, trajectory and spin desired by a golfer. A typical golf stroke comprises three primary steps, a backswing, a downswing, and a follow-through. Carrying out these three steps conventionally requires a golfer to maintain a precise grip, posture, alignment, balance, and movement when using a golf club. The mechanics of carrying out the steps of a golf stroke require a golfer to execute all steps precisely with a series of complicated bodily movements.

While the sport of golf enjoys widespread popularity worldwide, learning and improving a successful stroke or swing is typically difficult for novice golfers. Misalignments, improper posture, or errant movements while executing a golf swing typically lead to undesirable results, e.g. misplayed shots or even injury. Often a golfer must expend extensive time and resources to learn a golf swing. Learning a golf swing conventionally involves numerous hours of practice with the assistance of a trained professional and/or a process of trial and error. Developing a good swing demands that the novice golfer repeat the actions comprising a stroke or swing correctly many times until the motions become automatic. This conventional method of learning and training is an imperfect solution.

Further apparatus are desirable for training a golf stroke. Particularly desirable are apparatus which indicate the proper grip, posture, alignment, balance, and movement for correctly executing a golf stroke.

SUMMARY OF THE INVENTION

The present invention provides an efficient and convenient apparatus for training a golf stroke, particularly an apparatus that indicates the proper grip, posture, alignment, balance, and movement for correct executing a golf stroke. Apparatus of the invention may be used by a golfer swinging the apparatus using the method of swinging a standard golf club.

According to the invention, an apparatus for training a golf stroke comprises: a grip for orienting the user's hands; a restraining bar for orienting the user's arms, the restraining bar mechanically coupled to one end of the grip; a shaft mechanically coupled to the end of the grip opposite the restraining bar; and an indicator for the user to determine the orientation of the apparatus mechanically coupled to the end of the shaft opposite the grip. Such apparatus and related methods facilitate training a golfer to swing a golf club by executing a stroke with proper grip, posture, alignment, balance, and movement.

Various aspects and embodiments of the invention are described in further detail below.

BRIEF DESCRIPTION OF THE SEVERAL VIEWS OF THE DRAWINGS

The present invention described herein will become apparent from the following detailed description considered in connection with the accompanying drawings, which disclose several embodiments of the invention. It should be understood, however, that the drawings are designed for the purpose of illustration and not as limits of the invention.

DETAILED DESCRIPTION OF THE INVENTION

Figure 1A:
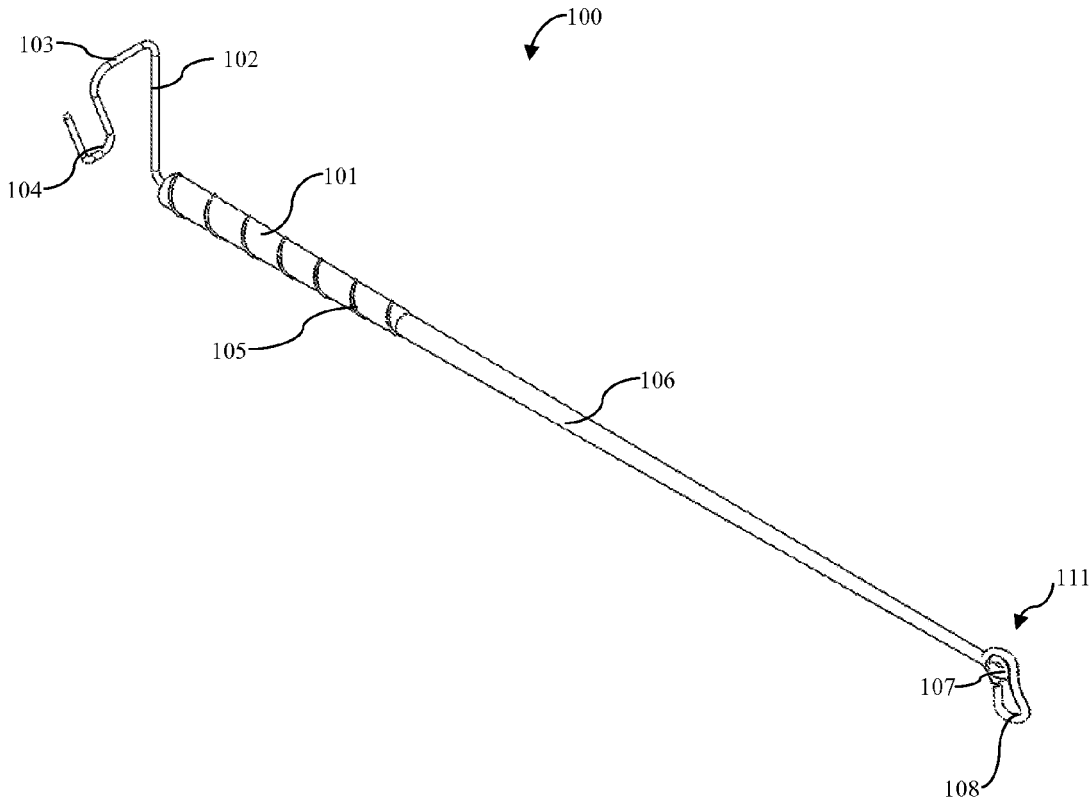
FIG. 1A is a perspective view of one embodiment of an apparatus for training a golf swing according to an embodiment of the invention.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention provides an efficient and convenient apparatus for training a golf stroke, particularly an apparatus that indicates the proper grip, posture, alignment, balance, and movement for correctly executing a golf stroke. Apparatus of the invention may be used by a golfer swinging the apparatus using the method of swinging a standard a golf club.

When apparatus of the invention are used, the user's hands, arms, and body are positioned by the apparatus to execute a proper golf stroke or swing. The apparatus of the invention easily allows a golfer to become accustomed to the look and feel of a proper golf stroke. Advantageously, the apparatus of the invention may be used in any area where a user can freely swing a golf club.

According to an embodiment, the apparatus of the invention generally comprises: a grip for orienting the user's hands; a shaft mechanically coupled to the grip; a restraining bar for orienting the user's arms, the restraining bar mechanically coupled to the shaft; and an indicator for the user to determine the orientation of the apparatus mechanically coupled to the shaft. By holding the apparatus a user will have the correct hand, arm and body position for the initial setup to ensure executing a proper golf stroke. When executing the three primary steps of a golf stroke, the backswing, downswing, and follow-through, the apparatus is shaped to ensure that the user maintains proper hand and arm position throughout the stroke. Additionally, the apparatus includes an indicator, which assists the user in determining that a stroke is being executed properly. This ensures that the user practices correctly, fostering the development of a consistent and reliable golf swing.

As illustrated in FIGS. 1A, 1B, 1C, 1D, and 1E an exemplary apparatus 100 of the invention comprises the following: a grip 101, a restraining bar 102, a shaft 105 and an indicator 111.

Figure 1B:
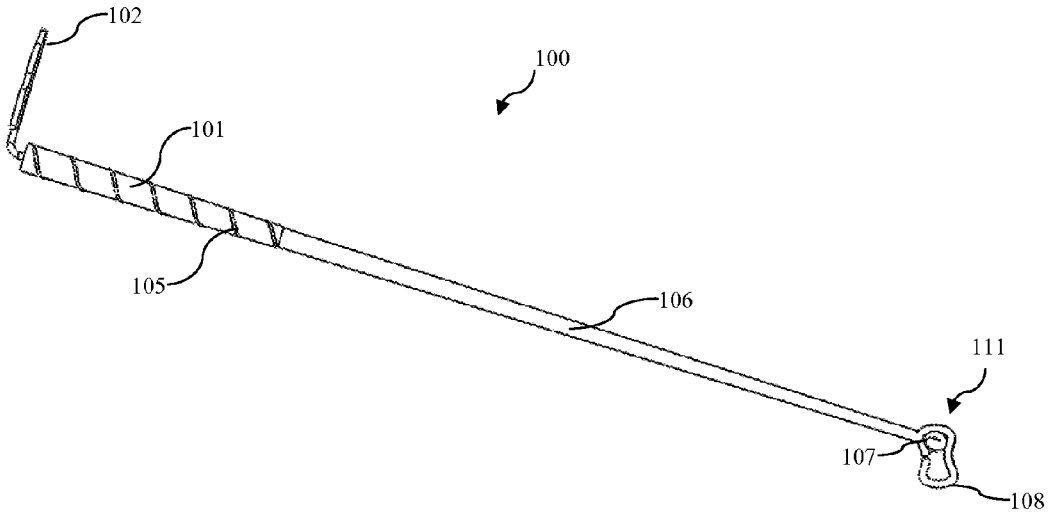
FIG. 1B is a rear perspective view of the apparatus of FIG. 1A, according to an embodiment of the invention.

As illustrated in FIGS. 1A and 1B, the grip 101 is mechanically coupled to a first side of the shaft 106. According to one embodiment, the grip 101 and the shaft 106 are formed as a single piece. According to another embodiment, the grip 101 and the shaft 106 are formed as two discrete components, which are then mechanically coupled when forming the apparatus 100. The one or multiple components of the grip 101 may be formed using any suitable methodology. In an exemplary embodiment, the components are formed by molding the same. The grip 101 comprises any suitable material. In an exemplary embodiment, the grip 101 comprises a material providing a frictional gripping force between a user and the grip 101. The grip 101 may be of any size, that is, any suitable length and diameter and shaped to resemble a conventional golf club grip. In an exemplary embodiment, the grip 101 comprises a rubber or durable plastic material.

In a further embodiment, the grip 101 may optionally contain molding 105. The molding may be comprised of any suitable material for allowing a user to maintain a hold on the grip 101. The molding 105 may be any suitable shape that facilitates the positioning of a user's fingers. For example, a right-hand dominant user may hold the apparatus 100 by placing each finger into the contours of molding 105 on a grip 101. Advantageously, the molding 105 can ensure that a user has a properly aligned grip for executing a successful golf stroke with the apparatus 100.

Figure 1C:
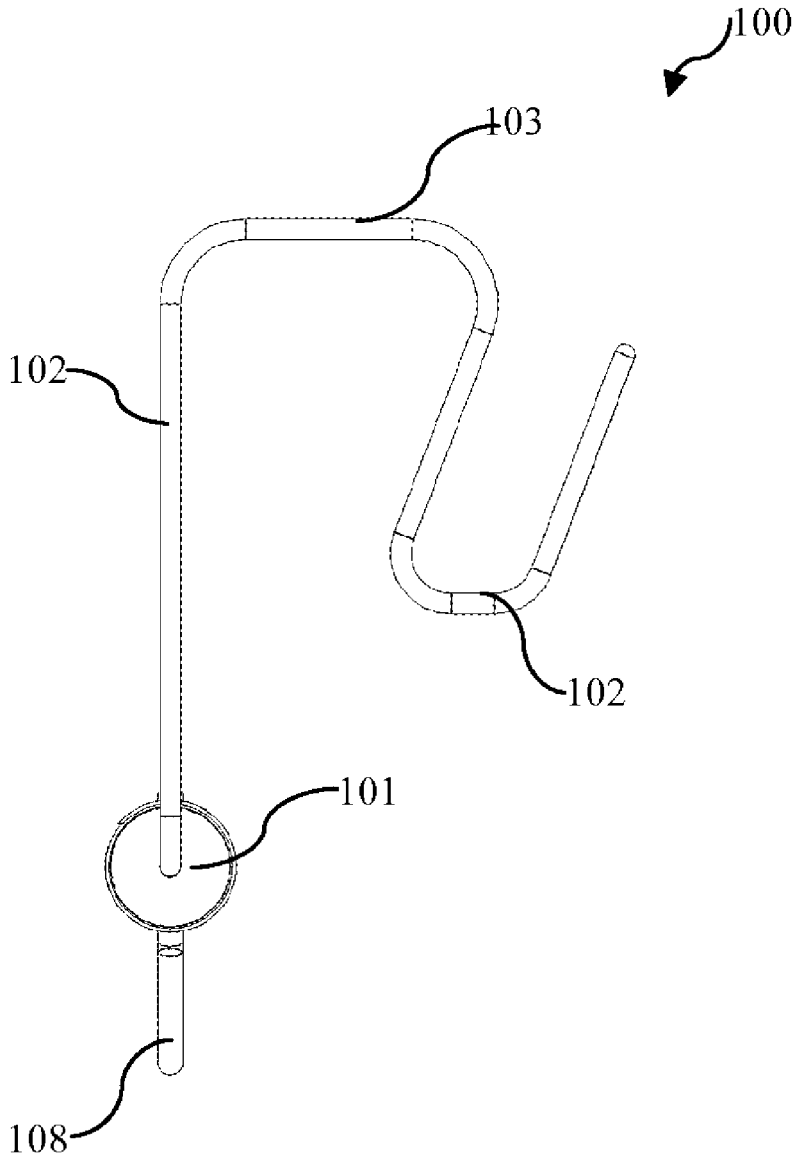
FIG. 1C is a side perspective view of the apparatus of FIG. 1A, according to an embodiment of the invention.

As illustrated in FIGS. 1A, 1B, and 1C, the restraining bar 102 comprises a formed rod that extends from the grip 101 at the end opposite the shaft 106. In the exemplary embodiment, the restraining bar 102 extends outwardly from the grip 101 and has a top side 103 and a curved loop 104. The width of the curved loop is suitable for accommodating the wrist of a user. In the exemplary embodiment the curved loop 104 is positioned on the right side of the apparatus 100, for the purpose of accommodating a right-hand dominant user. In another embodiment the curved loop 104 is positioned to the left side of the apparatus 100 to accommodate a left-hand dominant user. In an exemplary embodiment, the restraining bar 102 comprises a metallic or durable plastic material.

The shaft 106 may be formed from any suitable material. In an exemplary embodiment, the shaft 106 is made of a metallic or durable plastic material. The shaft 106 resembles the shaft of a conventional golf club. In alternate embodiments, the shaft 106 may be lengthened or shortened to resemble the golf clubs typically used by the user, e.g. junior sized golf clubs.

Figure 1D:
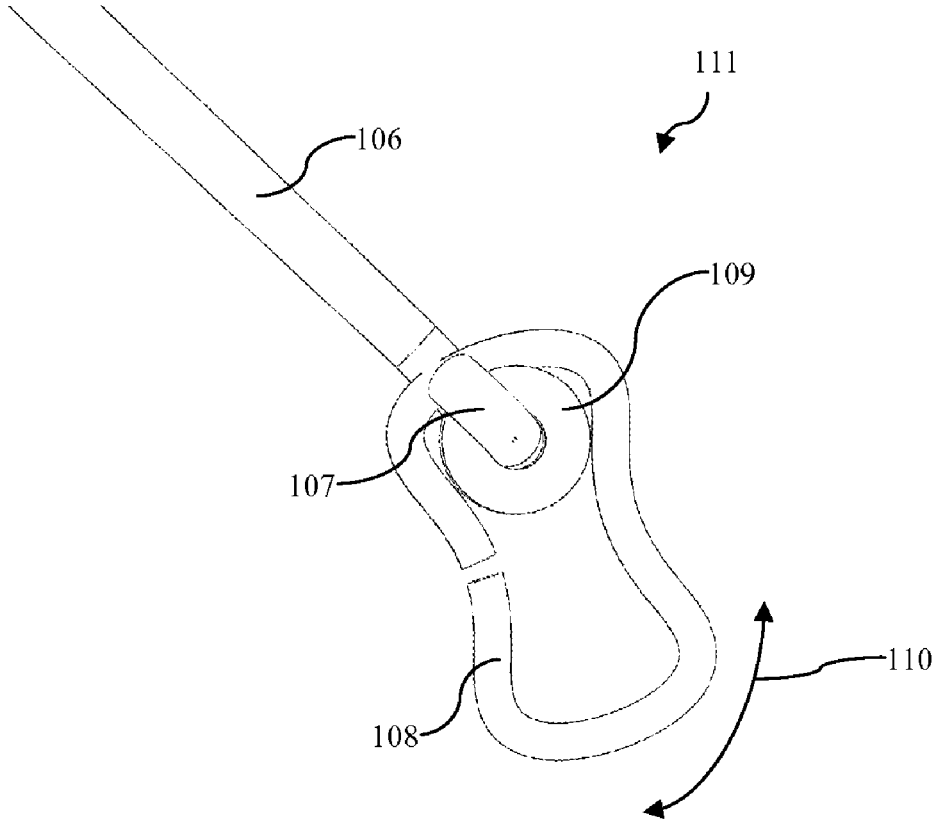
FIG. 1D is a side view of various components of the apparatus of FIG. 1A, according to an embodiment of the invention.
Figure 1E:
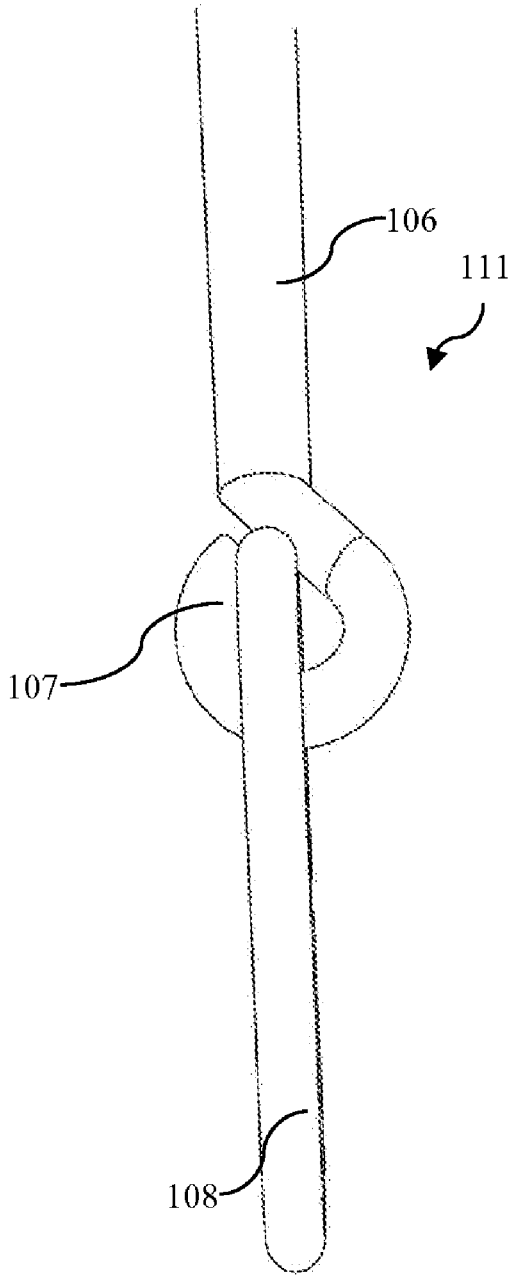
FIG. 1E is a top view of various components shown in FIG. 1D of the apparatus of FIG. 1A, according to an embodiment of the invention.

FIGS. 1D and 1E are side and top views, respectively, of various components of the apparatus of FIG. 1A. As illustrated therein, the various components act as an indicator 111 for a proper swing by the user. The indicator 111 comprises a hook 107, loop 108, and grommet 109. The hook 107 is coupled to the shaft 106 of the apparatus 100. The one or multiple components of the hook 107 may be formed using any suitable methodology or material. In an exemplary embodiment, the components are formed by molding. Fitted radially in the hook 107 is a loop 108. In an exemplary embodiment, the loop 108 is an oval-shaped ring. The loop 108 may further comprise a grommet 109 which constrains the loop to rotate within a single plane as indicated by the arrows 110 in FIG. 1D.

To use the apparatus the user stands as if facing a golf ball. This is known as addressing the ball. In this stance, the user stands with slightly flexed knees, and with shoulders in line with the target. The user's arms are in the correct position for a stroke, that is, with elbows pointing down toward the user's hip joints. For a right-handed player, the user grasps the apparatus in the grip 105 area using a proper grip. The inside of the user's left wrist is placed against the transition union bar, or, top side 103, while the right hand is placed in the U of the transition union bar, which is loop 104, with the inside of the wrist against the bar. The right hand should be placed on grip 105 with the thumb more toward the top of grip 105. The transition union bar or restraining bar 102 should be inline with the target. The desired hand position is in the middle of the stance.

Once in the proper stance and grip the user begins the swing or stroke. The user initiates the swing by transitioning to the back swing check. To do this, the user ensures that both elbows are pointed down and that the inside of both arms are pressed against the user's body. Both wrists must stay connected with the transition union bar, or restraining bar 102 throughout the back swing, down swing, and finish of the stroke or swing. The back swing is initiated by a turn of the user's shoulders. The transition union bar or restraining bar 102 will guide the user to the correct slot at the top of the back swing. At the top of the back swing the user is able to verify that the transition union bar or restraining bar 102 is level. This also allows the user to feel the location of that position, which forms the top of the backswing. In this position the user sees the slot finder transition or indicator 111 for the start of the down swing. In addition, the indicator 111 provides an audible sound or "click" at the top of the back swing that further guides the user in the correct motion.

The down swing begins with the turning of the user's shoulders. At this point the user should check to be sure that the transition union bar, or restraining bar 102 is level with the inside of the user's wrists still pressed against the restraining bar 102 with the elbows down. As the shoulders turn, the down swing begins and the user turns into the impact zone. The impact zone is where the golf ball is located during an actual golf swing. As the user enters the impact zone the transition union bar or restraining bar 102 automatically turns over the user's hands to release down the target line. At this point, the user sees and hears the slot finder, or loop 108, transition back at the finish of the swing.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for training a user's golf swing, comprising:

a grip for orienting the user's hands;

a shaft mechanically coupled to the grip;

a restraining bar for orienting the user's arms, mechanically coupled to the shaft; and an indicator for the user to determine an orientation of the apparatus mechanically coupled to the shaft, wherein the indicator comprises a hook, loop and grommet.

2. The apparatus of claim 1, wherein the grip is molded to position a user's fingers on the grip.

3. The apparatus of claim 2, wherein the restraining bar is reversed to accommodate a lefthand dominant user and the grip is molded to accommodate the left-hand dominant user.

4. The apparatus of claim 1, wherein the grip, hook, and shaft are formed from a single piece of material.

5. The apparatus of claim 1, wherein the grip is comprised of molded rubber.

6. The apparatus of claim 1, wherein the restraining bar is a single formed metal rod.

7. The apparatus of claim 1, wherein the restraining bar is reversed to accommodate a lefthand dominant user.

8. The apparatus of claim 1, wherein the apparatus is capable of positioning a user's hands and arms for setting up a golf stroke.

9. The apparatus of claim 1, wherein the apparatus is capable of positioning a user's hands and arms during a backswing, downswing, and follow-through.

10. The apparatus of claim 1, wherein the apparatus facilitates a user in training a golf stroke.

11. A method for applying training a golf stroke, comprising:

providing the apparatus of claim 1; and positioning a user's hands and arms on the apparatus.

12. The method of claim 11, wherein the step of positioning a user's hands and arms on the apparatus is accomplished by aligning the users fingers along a molded grip.

13. The method of claim 11, further comprising the steps:

performing a backswing;

performing a downswing;

performing a follow-through; and observing the indicator.

14. A method for training a golf stroke, comprising:

providing the apparatus of claim 1;

positioning a user's hands and arms on the apparatus;

performing a backswing;

performing a downswing;

performing a follow-through; and observing the indicator so that the hook rotates in the loop.

15. The method of claim 14, wherein the user observes the position of the restraining bar while carrying out the step of positioning a user's hands and arms on the apparatus.

16. The method of claim 14, wherein the user observes the position of the restraining bar and the hook in the loop during the step of performing the backswing.

17. The method of claim 14, wherein the user observes the position of the restraining bar and the hook in the loop during the step of performing the downswing.

18. An apparatus for training a user's golf swing, comprising:

a grip for orienting the user's hands;

a shaft mechanically coupled to the grip;

a restraining bar for orienting the user's arms, mechanically coupled to the shaft; and an indicator for the user to determine an orientation of the apparatus mechanically coupled to the shaft, wherein the restraining bar further comprises a colored marker on a top side for the user to determine the orientation of the apparatus.

* * * * *